US005946878A

United States Patent [19]

Grund et al.

[11] Patent Number: 5,946,878

[45] Date of Patent: Sep. 7, 1999

[54] COMPOSITE STRUCTURAL PANEL

[76] Inventors: Richard A. Grund, 8903-7 Eagleview Dr., West Chester, Ohio 45069; Donald Kneeter, 7 Birmingham Ct., Highlands Ranch, Colo. 80126

[21] Appl. No.: 09/057,117

[22] Filed: Apr. 8, 1998

Related U.S. Application Data

[60] Provisional application No. 60/047,744, May 27, 1997.

[51] Int. Cl.[6] ..... E04C 2/32

[52] U.S. Cl. ..... 52/630; 52/790.1; 52/793.1; 52/800.1; 52/800.11; 52/800.12; 52/800.13; 52/800.14; 52/800.15; 52/800.16; 52/800.17; 52/800.18; 428/167

[58] Field of Search ..... 52/630, 800.1, 52/800.11, 800.12, 800.13, 800.14, 800.15, 800.16, 800.17, 800.18, 793.1, 790.1; 428/167, 120

[56] References Cited

U.S. PATENT DOCUMENTS

| | | | |
|---|---|---|---|
| 2,597,786 | 5/1952 | Fontaine | 52/800.18 |
| 4,122,203 | 10/1978 | Stahl | 428/309 |
| 4,361,613 | 11/1982 | Bogner et al. | 428/119 |
| 4,757,665 | 7/1988 | Hardigg | 52/782 |
| 4,980,233 | 12/1990 | McCullough, Jr. et al. | 428/411.1 |
| 5,551,205 | 9/1996 | Kidder | 52/800.13 |

*Primary Examiner*—Christopher T. Kent
*Assistant Examiner*—Nkeisha J. Maddox

[57] ABSTRACT

A structural panel is described which includes a thin substantially rectangular member of preselected length, width and thickness having a substantially flat upper surface and a peripheral flanged edge and supported on the lower surface thereof by a first plurality of evenly spaced transverse ribs and a second greater plurality of evenly spaced longitudinal ribs, and at least one pair of intersecting diagonal ribs extending from diagonal corners of the member, the panel being hot formed of a composite of plastic, about 20 to 25 weight percent comminuted cellulosic matter or glass fibers and about 3 to 5 weight percent flame retardant.

13 Claims, 1 Drawing Sheet

COMPOSITE STRUCTURAL PANEL

This application claims the benefit of Provisional Application Ser. No. 60/047,744 filed May 27, 1997.

BACKGROUND OF THE INVENTION

The invention described herein relates to structural panels for wall boards, sheeting, flooring, roofing and the like, and more particularly to a plastic composite structural panel having light weight, high strength and fire resistance.

The invention relates to a structural board or panel substantially rectangular and flat in configuration and having a thickness which is substantially smaller in dimension than either the width or length of the panel, the particular novelty of the invention residing in a structural panel having a smooth upper surface and peripheral flanged edge, the upper surface supported by a first plurality of transverse ribs subtending the width of the panel and a second plurality of longitudinal ribs subtending the length of the panel and at least one pair of intersecting diagonal ribs extending from opposite corners of the panel, the panel comprising a plastic composite material reinforced primarily with comminuted wood chips or other cellulosic matter and including a flame retardant.

The structural panel of the invention may find substantial use in the construction industry as subfloor, wall sheeting or roof sheeting panels and may be configured to have substantial weight bearing capability. The panel may also have substantial utility in the fabrication of shipping containers, pallets and related applications.

SUMMARY OF THE INVENTION

It is a principal object of the invention to provide an improved structural panel.

It is another object of the invention to provide a structural building panel that is light in weight and has substantial load bearing to weight ratio.

It is another object of the invention to provide a structural panel comprising plastic composite material.

It is another object of the invention to provide a plastic composite structural panel which is substantially fire retardant.

These and other objects of the invention are met in a structural panel one preferred embodiment of which includes a thin substantially rectangular member of preselected length, width and thickness having a substantially flat upper surface and a peripheral flanged edge and supported on the lower surface thereof by a first plurality of evenly spaced transverse ribs and a second greater plurality of evenly spaced longitudinal ribs, and at least one pair of intersecting diagonal ribs extending from diagonal corners of the member, the panel being hot formed of a composite of plastic, containing about 20 to 25 weight percent comminuted cellulosic matter or glass fibers and about 3 to 5 weight percent flame retardant.

BRIEF DESCRIPTION OF THE DRAWINGS

The invention will be clearly understood from the written description to follow read in conjunction with the accompanying drawing in which.

DETAILED DESCRIPTION OF PREFERRED EMBODIMENTS

Figure 1:
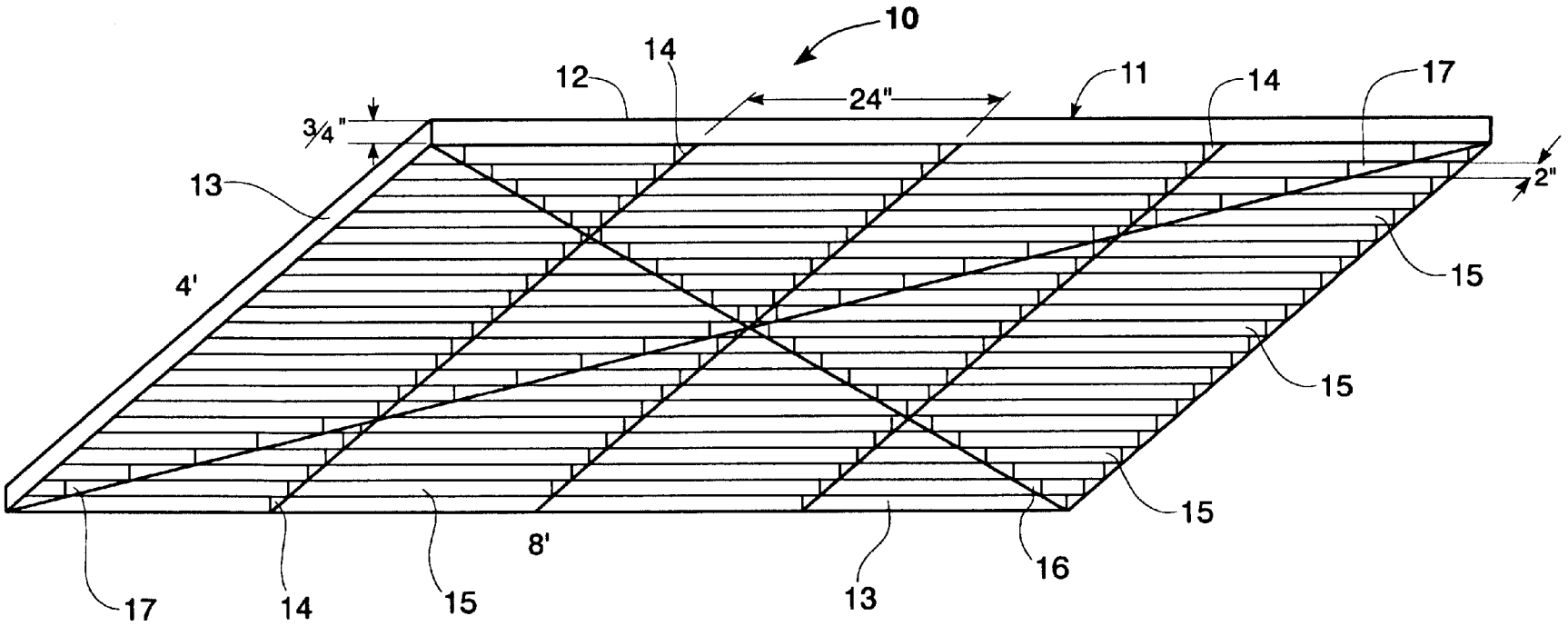
FIG. 1 is a perspective view of a representative panel of the invention showing a preferred configuration for the strengthening ribs of which the panel is comprised.

Referring now to the drawing, FIG. 1 shows a perspective view of a representative panel of the invention delineated by the numeral 10, showing a representative and preferred configuration for the strengthening ribs of which the panel is comprised. It may be stated at the outset that panel 10 may be sized with any desired length, width and thickness, the 4 foot by 8 foot by ¾ inch dimensions shown in FIG. 1 being only representative of a structural size customarily used in the construction industry for such applications as subfloor sheeting, roof sheeting or wall boards. Panel 10 may also be typically fabricated to other standard dimensions customary in the construction industry ranging in width from about one to four feet and in length from about one to eight feet, the specific dimensions not considered limiting of the invention as being selectable by one with skill in the applicable art practicing the invention.

The structure of panel 10 includes a thin, substantially rectangular member 11 having a substantially smooth, even upper surface 12 having a peripheral flange 13 formed perpendicular to surface 12. The width of flange 13 corresponds to the thickness of panel 10 desired by one fabricating and using panel 10 in accordance with the invention, the ¾ inch thickness shown in the drawing also not intended as a limitation on the scope of the invention. Panel 10 may ordinarily range in thickness from about ½ inch for application to wall boards, sheeting or the like to about 4 inches for application to heavy duty pallets. Member 11 is supported by a first plurality of evenly spaced transverse ribs 14 subtending the width of panel 10 and extending between the lengthwise portions of peripheral flange 13. Member 11 is further supported by a second plurality of evenly spaced longitudinal ribs 15 subtending the length of panel 10 and extending between the widthwise portions of peripheral flange 13. Member 11 is further supported by at least one pair of diagonal ribs 16 and 17 subtending the diagonal dimensions of panel 10 and extending between the corners formed by flange 13 as shown in FIG. 1. It is noted that a number of diagonal rib pairs may be included which lie in each half of panel 10 or in each quadrant of panel 10 or in any further division of panel 10 as might be appropriate for a particular weight bearing application, or for the purpose of defining a panel having two or more substantially identical adjacent rectangular sections or subdivisions. Each of the ribs 14 and 15 and 16 and 17 intersect as formed as described below and preferably have a width corresponding to the width of flange 13 and the designed thickness of panel 10. The thickness of ribs 14, 15, 16 and 17 and of flange 13 and of member 11 may be selected according to the intended use and load bearing requirement of panel 10, and may ordinarily range from about ⅛ to about ⅜ inch for structural panels intended for use in most structural applications contemplated for this invention. A feature of the invention resides in the second plurality or ribs 15 being substantially greater in number than the first plurality of ribs 14 which defines an efficiently designed, economically fabricatable and substantially load bearing panel. The exact spacing (and corresponding pluralities) of each of ribs 14 and 15 is not intended to be a limitation on the invention and may be selected according to the intended use of the panel as a structural panel member in building construction applications, in shipping container or pallet fabrication or other application envisioned by one practiced in the applicable art. Spacings for ribs 15 may ordinarily be 2 to 6 inches and spacings for ribs 14 may ordinarily be 12 to 24 inches depending on the structural application to which the panel is applied and the load bearing requirement for the panel in the particluar application.

Panel 10 is preferably constructed of plastic such as polyethylene, polypropylene, polystyrene, polyvinyl chloride or others, or a mixture of plastics, including recovered waste plastics. The plastic is preferably reinforced with 20 to 25 weight percent wood chips or other comminuted cellulosic fiber material or glass fibers, and includes a flame retardant preferably in the range of about 3 to 5 weight percent alumina trihydrate, antimony oxide, bromine compounds, zinc stannates or other additive materials known in the plastics industry suitable to retard the combustion of the (primarily plastic) structural panel. The panel may be formed as a unitary member by any suitable method such as compression molding, injection molding or thermoforming. The process for forming panel 10 may ordinarily include grinding the plastic to be used to a desired comminuted form, adding the wood chips or glass fibers and flame retardant in the desired percentage amounts, heating and blending the mixture in the temperature range of about 150 to 400° C., injecting the heated mixture into the appropriate mold, cooling the molded panel and removing the panel from the mold. The exact process and process parameters may be selected from any of the present commercially used methods for forming plastics modified to accommodate the configuration and composition of panel 10.

Scale model tests and calculations on the load bearing capability of panel 10 indicated strengths well in excess of the 40 pounds per square foot normally desired for subfloor or roof sheeting applications in the construction industry.

The invention described herein therefore provides a plastic composite structural panel having light weight, high strength and fire resistance. The invention as described is not to be construed as strictly limited by the foregoing description of representative embodiments, as the invention as described may be modified by one skilled in the applicable art without departing from the spirit of these teachings or from the scope of the appended claims.

What is claimed is:

1. A structural panel comprising a thin substantially rectangular member of preselected length, width and thickness supporting a substantially flat upper surface and a peripheral flanged edge, said member supported on the lower surface thereof by a first plurality of substantially evenly spaced transverse ribs subtending the width of said member and a second plurality of substantially evenly spaced longitudinal ribs subtending the length of said member, said second plurality being greater than said first plurality, and at least one pair of intersecting diagonal ribs extending from respective diagonal corners of said member, said member and ribs comprising a molded unitary structure of a composite material composed of plastic, comminuted cellulosic matter or glass fibers, and a flame retardant.

2. The structural panel of claim 1 having a width in the range of about one to four feet and length in the range of from about one to eight feet.

3. The structural panel of claim 2 wherein said flange and said ribs have a width in the range of about one-half to about four inches and thickness in the range of about one-eighth to about three-eighths inch.

4. The structural panel of claim 1 wherein said second plurality is substantially greater than said first plurality.

5. The structural panel of claim 1 wherein said cellulosic matter comprises comminuted wood chips.

6. The structual panel of claim 1 wherein said plastic is selected from the group consisting of polyethylene, polypropylene, polystyrene and polyvinyl chloride.

7. The structural panel of claim 6 wherein said composite material comprises 20 to 25 weight percent cellulosic matter, and 3 to 5 weight percent flame retardant selected from the group consisting of alumina trihydrate, antimony oxide, bromine compounds and zinc stannates.

8. A structural panel comprising a thin substantially rectangular member of preselected length, width and thickness supporting a substantially flat upper surface and a peripheral flanged edge, said member supported on the lower surface thereof by a first plurality of substantially evenly spaced transverse ribs subtending the width of said member and a second plurality of substantially evenly spaced longitudinal ribs subtending the length of said member, said second plurality being greater than said first plurality, and at least one pair of intersecting diagonal ribs extending from respective diagonal corners of said member, said member and ribs comprising a molded unitary structure of a composite material composed of plastic containing 20 to 25 weight percent comminuted cellulosic matter or glass fibers and 3 to 5 weight percent flame retardant.

9. The structural panel of claim 8 having a width in the range of about one to four feet and length in the range of from about one to eight feet.

10. The structural panel of claim 9 wherein said flange and said ribs have a width in the range of about one-half to about four inches and thickness in the range of about one-eighth to about three-eighths inch.

11. The structural panel of claim 8 wherein said second plurality is substantially greater than said first plurality.

12. The structural panel of claim 8 wherein said cellulosic matter comprises comminuted wood chips and said flame retardant is selected from the group consisting of alumina trihydrate, antimony oxide, bromine compounds and zinc stannates.

13. The structual panel of claim 8 wherein said plastic is selected from the group consisting of polyethylene, polypropylene, polystyrene and polyvinyl chloride.

* * * * *